US012082724B2

(12) United States Patent
Green

(10) Patent No.: US 12,082,724 B2
(45) **Date of Patent: *Sep. 10, 2024**

(54) ADJUSTABLE LID FOR COVERING A GLASS OR CUP

(71) Applicant: Jake Green, Merrick, NY (US)

(72) Inventor: Jake Green, Merrick, NY (US)

(73) Assignee: THE DRINK ANGEL LLC, Merrick, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/186,310

(22) Filed: Feb. 26, 2021

(65) Prior Publication Data

US 2021/0177174 A1 Jun. 17, 2021

Related U.S. Application Data

(62) Division of application No. 16/586,923, filed on Sep. 28, 2019.

(51) Int. Cl.
*A47G 19/22* (2006.01)

(52) U.S. Cl.
CPC ..... *A47G 19/2272* (2013.01); *A47G 19/2227* (2013.01); *A47G 2400/123* (2013.01)

(58) Field of Classification Search
CPC ..... A47G 19/22; A47G 19/2205; A47G 19/2222; A47G 19/2227; A47G 19/2266; A47G 19/2272; A47G 2400/123; B65D 2251/08; B65D 43/00; B65D 43/02; B65D 43/0204
USPC ..... 220/287
See application file for complete search history.

(56) References Cited

U.S. PATENT DOCUMENTS

| | | | | |
|---|---|---|---|---|
| 5,294,014 | A * | 3/1994 | Wyatt | B65D 47/265 222/472 |
| 5,392,949 | A * | 2/1995 | McKenna | B65D 47/0847 220/276 |
| 5,947,323 | A * | 9/1999 | Freek | B65D 43/0256 220/709 |
| 7,156,253 | B2 | 1/2007 | Ziegler | |
| 9,526,362 | B2 * | 12/2016 | Wang | B65D 43/06 |
| 2003/0089713 | A1 | 5/2003 | Belt et al. | |
| 2007/0178284 | A1 | 8/2007 | Barry | |
| 2008/0072412 | A1 | 3/2008 | Solazzi | |
| 2009/0020546 | A1 | 1/2009 | Kiehne | |
| 2010/0200452 | A1 | 8/2010 | Solazzi | |
| 2013/0082067 | A1 | 4/2013 | Drogo | |
| 2013/0134165 | A1 | 5/2013 | Ciccotelli et al. | |
| 2014/0299601 | A1 * | 10/2014 | Schiavone | A47G 19/2205 220/288 |
| 2015/0360807 | A1 | 12/2015 | Ciccotelli et al. | |
| 2016/0073808 | A1 | 3/2016 | Drogo | |
| 2018/0177315 | A1 * | 6/2018 | Thrasher | A47G 19/2227 |
| 2019/0270557 | A1 * | 9/2019 | Smith-Phillips | B65D 33/28 |

* cited by examiner

*Primary Examiner* — Javier A Pagan
(74) *Attorney, Agent, or Firm* — Philip M. Weiss; Weiss & Weiss

(57) ABSTRACT

A device comprising an adjustable lid for covering a glass or cup that covers the top of the glass or cup and prevents substances from being placed in the glass or cup.

10 Claims, 4 Drawing Sheets

Fig. 1
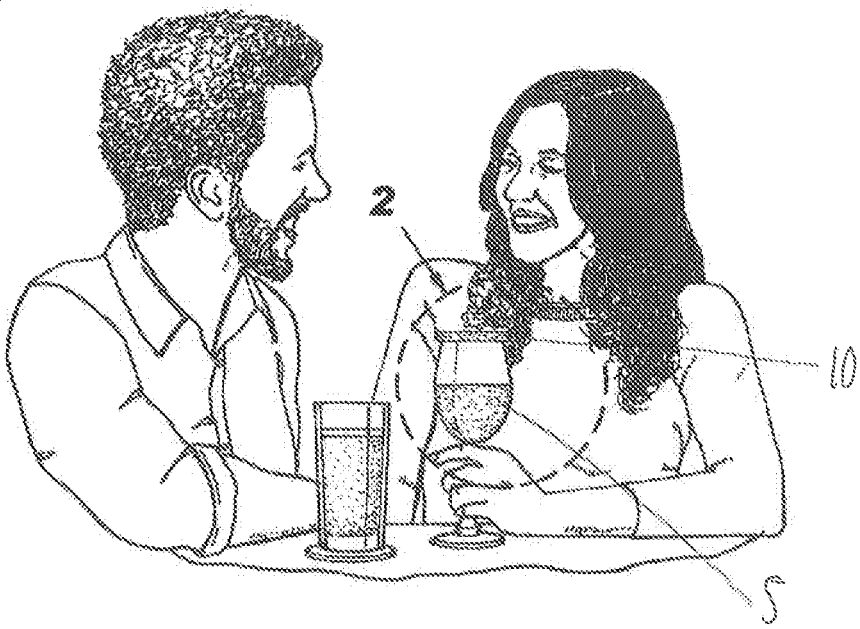
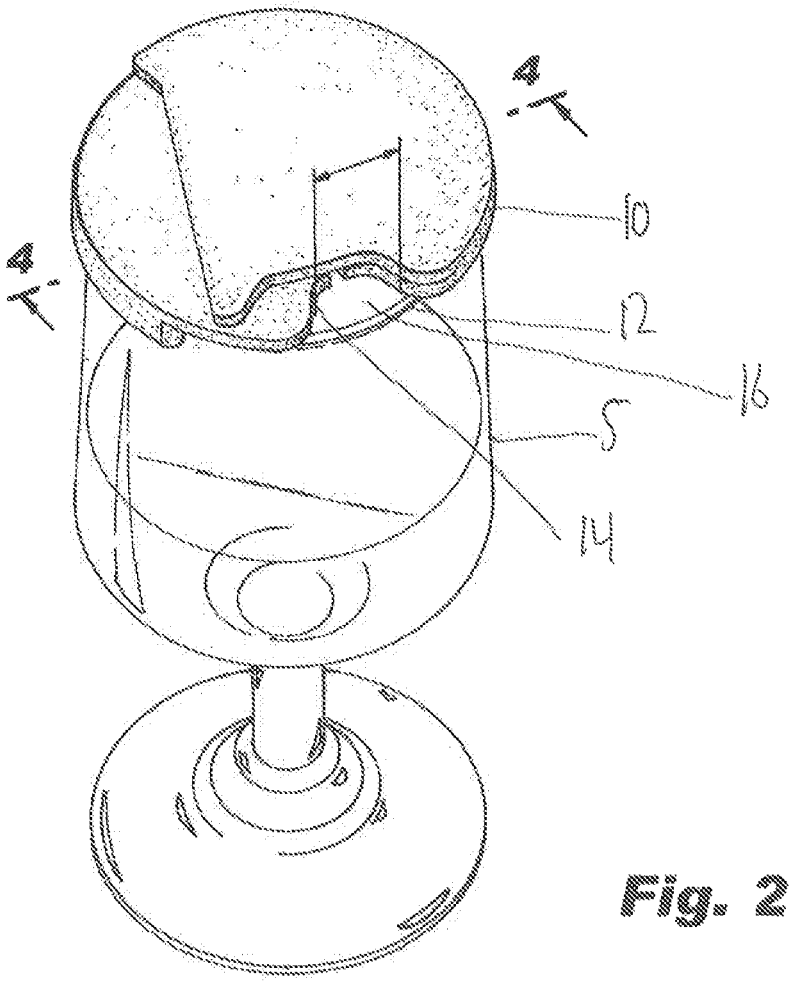
Fig. 2

ADJUSTABLE LID FOR COVERING A GLASS OR CUP

FIELD OF THE INVENTION

The present invention relates to an adjustable lid for covering a glass or cup that covers the top of the glass or cup and prevents substances from being placed in the cup.

BACKGROUND OF THE INVENTION

A person may attend a party and have a drink. When that person put a drink down, with the top of the glass or cup wide open, the drink was vulnerable to having a drug or other substance be placed in the drink unbeknownst to the person. Further, when a person puts a drink down and then later picks up the drink, the person cannot be certain that they have picked up their drink, since there is no indicia that the drink that they put down is the same drink that they are later picking up to drink.

U.S. Pat. No. 7,156,253 relates to an adaptor for a child to drink from a cup having a bead extending around an open end of the cup. The adaptor has an annular collar that supports the cup by engaging a lower portion of a bead of the cup around a substantial portion of a periphery of the bead. A lid is removably engageable with the collar. The lid has an annular flange depending from a lower surface toward the collar with flange abutting interior side of the wall of the cup when lid engages collar to form fluid seal with the cup. Lid has a channel formed therein located between flange and periphery of lid and encircling the flange. Channel encloses upper portion of the bead of the cup. Lid has child drinking spout on exterior surface of lid adjacent peripheral edge of the lid. Spout is in fluid communication with the cup during use of the adaptor.

US Patent publication 2003/0089713 relates to a reclosable lid for a drinking cup comprising a base and a cap in mating relationship which rotate relative to each other. Both the base and cap have an aperture for delivery of liquid therethrough. When the apertures are aligned, liquid may be removed from the cup. When cap is rotated relative to base so the apertures are offset, removal and spillage of liquid is prevented.

US patent publication 20070178284 relates to a drinking glass cover comprised of thin film on a carrier. Film is made of material that clings to smooth surfaces or is coated with an adhesive to remain adhered over glass opening. Film material may or may not retain its integrity when pierced by a straw or has a straw opening. Film may have a tab for removal from the carrier. Carrier is paper, cardboard, or plastic panel to which film is adhered. Carrier may be scored to facilitate removal of film. Carrier has a surface coating or layer facilitating adherence or release by the film. Carrier can be designed for use before or after film is removed. Carrier or film can be imprinted.

US patent publications 20080072412 and 20100200452 relate to a method and apparatus for covering and identifying a container utilizing a thin film and a frame. The thin film material covers a through hole in the frame and has a perforation that defines an outer detaching surface an inner covering surface commensurate with container opening. Method comprises attaching thin film material to frame having through hole; disposing frame onto open top surface of the container; depressing portion of frame to detach thin-film from frame along perforation and sliding frame coaxially to circumscribe base of the container where it identifies information about the container.

US patent publication 20090020546 relates to a tamper resistant closure for a cup-like container having a rim surrounding the open end of the container, rim having a rib on inner side with which a peripheral flange of the container can cooperate to inhibit removal of closure from the container. Closure includes a dispensing spout through which contents of container can be consumed, spout having a series of spaced slots. Closure can be in form of stopper having a similar dispensing spout, stopper adapted to be located in the neck of a bottle-like container.

US patent publications 20130134165 and 20150360807 relate to a protective cover comprising a flexible material, such as latex, and may be colored or have a design. A hole may be included for inserting a straw or as a drinking spout, and hole may be reinforced. Protective cover may comprise a central circular portion and a circumferential side portion and be sized for bar glasses. An edge on side portion may form by folding edge over itself and adhering folded layers together, providing resilient elastic band for retaining the protective cover on a glass.

US patent publication 20140299601 relates to a container for drinking drinks, having a body made of shatterproof material comprising a broad opening for forming a glass, goblet, or a tankard, and a lid removably associated with the opening and with the base of the container by means of a threaded coupling.

US patent publication 20180177315 relates to a drinking container lid for covering an opening of a drinking container, drinking container having a rim defining the opening. Lid comprises a hollow casing with an opening formed in the casing. An elastic material completely encircles the opening. Lid is positionable about the rim of container completely covering opening of the container. Elastic material releasably secures the lid about the rim of the container. Lid enables users to cover, protect, and personalize the drinking vessel and protect health, hygiene and peace of mind.

U.S. Patent Publications 2013/0082067 and 2016/0073808 relate to an improved beverage lid design stretching over a glass within a one inch diameter of its original position. The lids are elastic and have plastic properties. The lid covers alcoholic beverages served by an establishment that serves open alcoholic beverages to the public. The lid comprises certain sayings on top of the lid that make a predator aware that the potential victim is aware of "date rape". The lid will cover the beverage and prevent someone from casually slipping a rouffie or other type of drug into the glass. The cover will protect against spillage.

The website "justcapit.net" relates to covering a drink. Justcapit sells bright pink silicon lids that cover and protect a drink that drugs cannot be placed without removing the lid. The silicon lid is made to fit the majority of glasses used in nightclub or party setting. One size fits all. The lid can also be used on beer and soda cans. The website sells a package of a glass lid and two beer bottle lids.

SUMMARY OF THE INVENTION

The present invention relates to a device that serves as a lid to a cup or glass. The lid is placed on top of the cup or glass. The lid is adjustable so that it can fit different size cups or glasses.

It is an object of the present invention for the lid to comprise two pieces.

It is an object of the present invention for the lid to be held together at a pivot point that allows the top half of the lid to spin, and based on this, the lid can open and close to fit numerous size cups or glasses.

It is an object of the present invention for the lid to be attached to the outside of the glass or cup.

It is an object of the present invention for the lid to be attached to the inside of the glass or cup.

It is an object of the present invention for the lid to be approximately 84 mm wide by 85.5 mm long.

It is an object of the present invention for the two piece lid to comprise a top half and a bottom half of the lid.

It is an object of the present invention for the top half of the lid to be in the shape of a semi circle that attaches to the bottom half of the lid at the pivot point. The lid has an indentation which creates an opening when the lid is placed on a glass or cup. This allows a user to drink a beverage from the cup or glass when the lid is attached to the glass or cup.

It is an object of the present invention for the indentation to be approximately 28 mm wide at its largest opening, which allows ample amounts of consumption space while still covering the majority of the cup.

It is an object of the present invention for there to be a direct opening in the lid when the lid is not expanded. It is an object of the present invention for this opening to be approximately 18 mm wide.

It is an object of the present invention for the direct opening to allow for a straw to pass through the lid for consumption by the user.

It is an object of the present invention for the lid to have a mechanism that can close the opening when the user is not drinking and then open the opening when the user wishes to drink from the glass or cup.

It is an object of the present invention for the bottom of the lid to comprise a circular shape that features a v-shaped cut-out. This cut-out allows the lid to expand to fit the cup or glass. The cut-out comprises the same size approximately 18 mm hole when the hole is in its smallest position.

It is an object of the present invention for the bottom of the lid to comprise approximately a 7.6 mm ridge with an indentation in it wherein the ridge grips onto the cup or glass to hold the lid onto the cup or glass.

It is an object of the present invention for the lid to prevent substances from being placed into the cup or glass when the lid is securely fastened to the cup or glass.

It is an object of the present invention for the lid to have indicia on the top of the lid facing outside of the glass or cup so that a user can confirm that the attached lid is on the glass that he or she was drinking from.

It is an object of the present invention for the indicia to be specific to the user so there are not duplicate copies of the lid used by other persons at any establishment.

It is an object of the present invention for an establishment to provide lids having unique indicia to each person who walks into the establishment so that the lid having the unique indicia can be placed on a cup or glass that is recognized by the user only.

BRIEF DESCRIPTION OF THE DRAWINGS

FIG. 1 shows the device on a wine glass being used with a person.

FIG. 2 shows the glass from FIG. 1 showing the device attached to the glass having an opening.

DETAILED DESCRIPTION OF THE INVENTION

Figure 3:
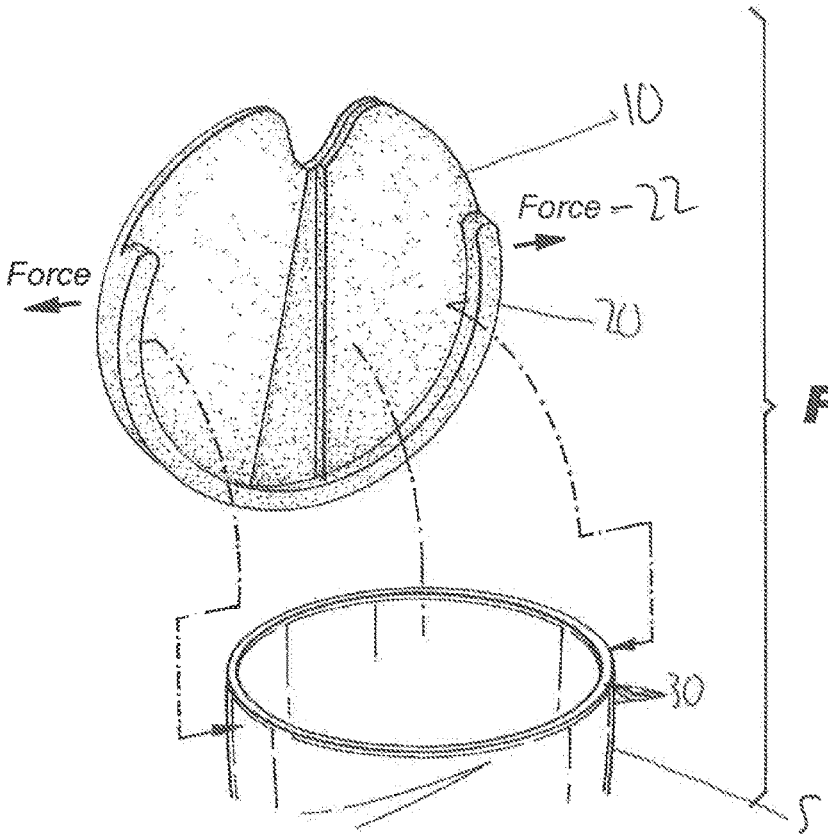
FIG. 3 shows the underside of the device unattached to the glass.

FIG. 1 shows a person holding a glass 5 having the device 10 attached to the glass 5 above the opening of the glass 5.

FIG. 2 shows the glass 5 having the device 10 covering a majority of an opening 12 on top of the glass 5. The device 10 has an indentation 14 which creates an opening 16 so a person can drink their beverage. The device 10 covering almost all of the opening 12 of the glass 5 prevents a third party from adding substances to the glass 5.

FIG. 3 shows the glass 5 with the device 10 above it. The device 10 has ridges 20 which are forced apart by a force 22 which then allows the ridges 20 to settle around the outside of the glass 30.

Figure 4:
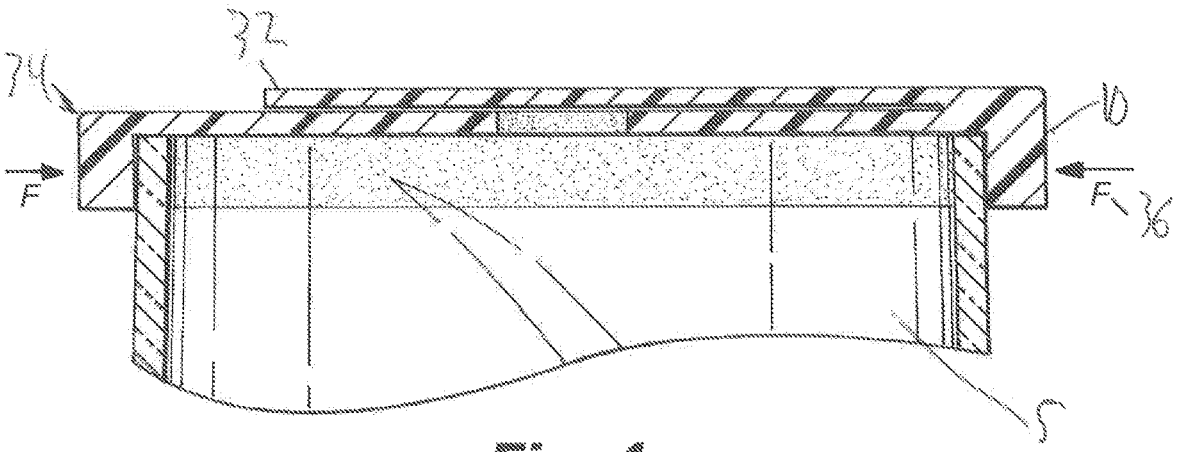
FIG. 4 shows the device affixed to the glass from FIG. 2.

FIG. 4 shows the top part of the glass 5 having the lid 10 attached to the glass 5. The lid is comprised of a top piece 32 and a bottom piece 34. A force 36 attaches the lid to the top of the glass 5.

Figure 5:
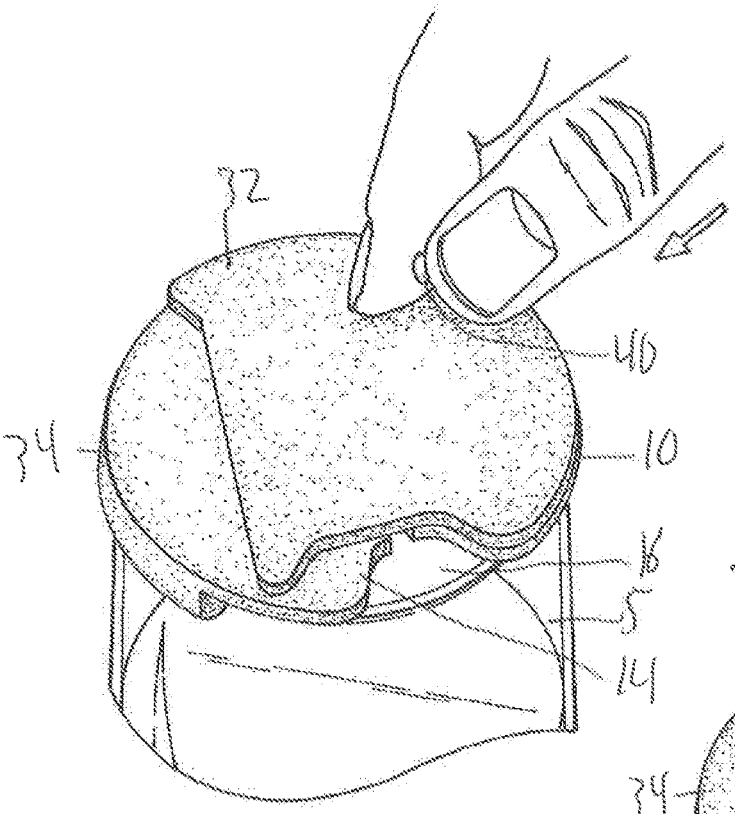
FIG. 5 shows the device affixed to the glass and a person trying to place a drug into the glass.

FIG. 5 shows the lid 10 secured to the glass 5. It further shows the top of the lid 32 and the bottom of the lid 34. It is further shown the indentation 14 which creates an opening 16. As shown in FIG. 5 a third party having a substance 40 is prevented from placing the substance 40 into the glass 5 by the lid 10.

Figure 6:
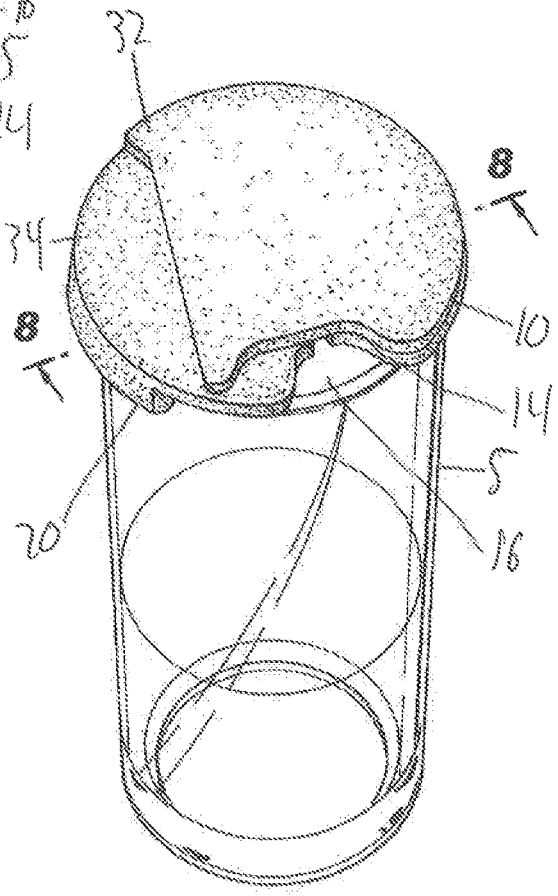
FIG. 6 shows the device attached to a glass.

FIG. 6 shows the glass 5 having the lid 10 secured to the glass 5. The lid 10 is comprised of the top of the lid 32 and bottom of the lid 34 and also has an indentation 14 which provides an opening 16 in the glass 5. FIG. 6 further shows the ridges 20 gripped around the edge of the glass 5.

Figure 7:
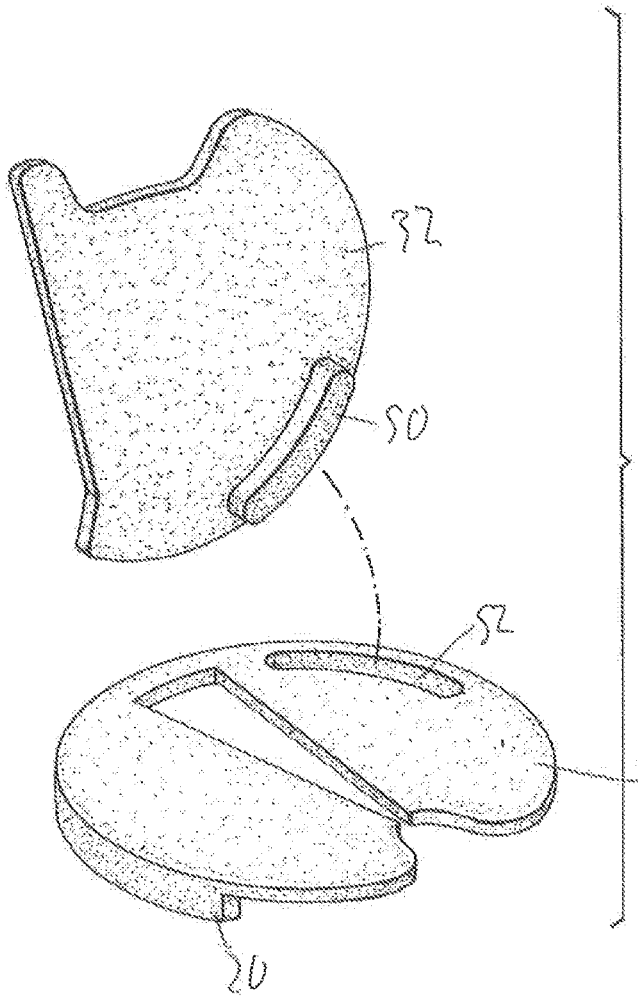
FIG. 7 shows the device in two separate parts.

FIG. 7 shows the top of the lid 32 having an extension 50 which is placed into a slot 52 of the bottom of the lid 34 attaching the two pieces together. FIG. 7 further shows the ridge 20.

Figure 8:
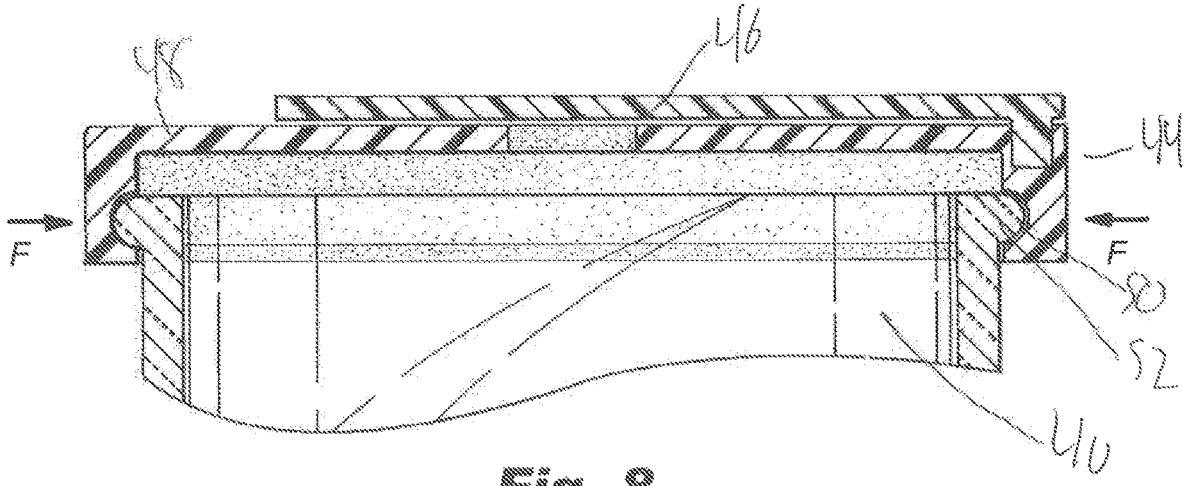
FIG. 8 shows the device attached to a glass.

FIG. 8 shows a glass 40 having a rim 42. The lid 44 is comprised of the top of the lid 46 and bottom of the lid 48. An inner groove 50 of the lid 44 accepts a bead 52 from the rim of a typical pint glass.

The invention claimed is:

1. A device for covering a majority of an opening on top of a glass or cup comprising:

a lid having an indentation creating a single opening;

ridges configured to be forced apart by a force that allows said ridges to settle around an outside of said glass or cup;

said lid comprised of a top piece and a bottom piece;

said top piece and said bottom piece being two separate pieces;

said top piece of said lid and is on a higher plane then said bottom piece of said lid;

said lid has an extension placed into a slot of a bottom of said lid attaching said top piece and said bottom piece together;

said opening being at an edge of said lid.

2. The device of claim 1 wherein said lid is adjustable so that said lid fits different size cups or glasses.

3. The device of claim 1 wherein said lid is approximately 84 mm wide by 85.5 mm long.

4. The device of claim 1 wherein said indentation is approximately 28 mm wide at its largest said opening, providing ample amounts of consumption space while still covering a majority of said cup or glass.

5. The device of claim 4 wherein said opening of said lid is large enough for a straw to pass through the lid.

6. The device of claim 1 further comprising a mechanism to close said opening of said lid.

7. The device of claim 1 wherein said bottom of said lid comprises a circular shape that features a v-shaped cut-out that allows said lid to expand to fit said cup or glass.

8. The device of claim 1 wherein said lid prevents substances from being placed into said cup or glass when said lid is securely fastened to said cup or glass.

9. The device of claim 1 further comprising indicia on top of said lid facing outside of said glass or cup.

10. The device of claim 9 wherein an establishment provides said lids having unique indicia to each person who walks into said establishment so said lid having said unique indicia is placed on said cup or glass.

* * * * *